US011111663B2

(12) United States Patent
Rauwerdink et al.

(10) Patent No.: US 11,111,663 B2
(45) Date of Patent: Sep. 7, 2021

(54) URINAL WITH TRAPWAY CONNECTION SYSTEM

(71) Applicant: Kohler Co., Kohler, WI (US)

(72) Inventors: Jeremiah J. Rauwerdink, Sheboygan, WI (US); Keith E. Muellenbach, Sheboygan, WI (US)

(73) Assignee: Kohler Co., Kohler, WI (US)

( * ) Notice: Subject to any disclaimer, the term of this patent is extended or adjusted under 35 U.S.C. 154(b) by 181 days.

(21) Appl. No.: 16/120,613

(22) Filed: Sep. 4, 2018

(65) Prior Publication Data

US 2019/0085549 A1 Mar. 21, 2019

Related U.S. Application Data

(60) Provisional application No. 62/559,341, filed on Sep. 15, 2017.

(51) Int. Cl.
*E03D 13/00* (2006.01)
*E03D 11/18* (2006.01)

(52) U.S. Cl.
CPC ..... *E03D 13/00* (2013.01); *E03D 11/18* (2013.01)

(58) Field of Classification Search
CPC ..... E03D 13/00
USPC ..... 4/311, 252.2, 309, 310
See application file for complete search history.

(56) References Cited

U.S. PATENT DOCUMENTS 6,701,541 B2 3/2004 Romagna et al.
6,757,918 B2 7/2004 Hogger
931,941 A1* 4/2007 Madden ..... E03C 1/28 4/301
7,636,957 B2 12/2009 Funari
8,572,768 B2 11/2013 Dewitt et al.
8,881,318 B2 11/2014 Stammel et al.
8,910,321 B2 12/2014 Coronado et al.
2002/0166162 A1 11/2002 Romagna et al.
2003/0150051 A1* 8/2003 Hogger ..... E03C 1/28 4/310
2006/0101565 A1 5/2006 Cummings
(Continued)

FOREIGN PATENT DOCUMENTS

AR 074256 A1 1/2011
AT 296923 T 6/2005
(Continued)

OTHER PUBLICATIONS

European Search Report re: Application No. EP18193505.7 dated Feb. 21, 2019; 14 pgs.
(Continued)

*Primary Examiner* — Lauren A Crane
(74) *Attorney, Agent, or Firm* — Lempia Summerfield Katz LLC

(57) ABSTRACT

A urinal includes a bowl assembly and a trapway assembly. The bowl assembly includes a body. The body defines a bowl and a cavity. The cavity includes a receiver configured to receive a bracket. The trapway assembly is configured to be located in the cavity. The trapway assembly is configured to fluidly couple the bowl to a drain. The trapway assembly is configured to be coupled to the drain separate from the bowl assembly. The bowl assembly is configured to be coupled to a wall separate from the trapway assembly.

20 Claims, 6 Drawing Sheets

(56) References Cited

U.S. PATENT DOCUMENTS

| | | | | |
|---|---|---|---|---|
| 2007/0074337 | A1* | 4/2007 | Funari | E03C 1/28 4/301 |
| 2010/0088811 | A1 | 4/2010 | Coronado et al. | |
| 2011/0126346 | A1 | 6/2011 | Stammel et al. | |
| 2011/0162133 | A1* | 7/2011 | DeWitt | E03D 11/13 4/252.6 |

FOREIGN PATENT DOCUMENTS

| | | | |
|---|---|---|---|
| AT | 428031 | T | 4/2009 |
| AU | 2005229746 | B2 | 1/2011 |
| AU | 2010246548 | B2 | 12/2011 |
| AU | 2010246545 | B2 | 1/2012 |
| CA | 2525819 | C | 9/2012 |
| CA | 2739785 | C | 3/2015 |
| CN | 101230592 | A | 7/2008 |
| CN | 1775159 | B | 2/2011 |
| CN | 202187413 | U | 4/2012 |
| CN | 102140818 | B | 6/2014 |
| DE | 41 20 768 | C2 | 2/2001 |
| DE | 50203264-D1 | | 7/2005 |
| DE | 50213420-D1 | | 5/2009 |
| DE | 10 2009 055 977 | A1 | 6/2011 |
| DE | 10 2010 046 698 | A1 | 3/2012 |
| DE | 60 2005 045 446-D1 | | 2/2015 |
| DE | 50 2010 008 949-D1 | | 4/2015 |
| DK | 1657370 | T3 | 3/2015 |
| EG | 26254 | A | 6/2013 |
| EP | 1 335 076 | B1 | 6/2005 |
| EP | 1 785 077 | A1 | 5/2007 |
| EP | 1 247 910 | B1 | 4/2009 |
| EP | 1 657 370 | B1 | 12/2014 |
| EP | 2 333 169 | B1 | 2/2015 |
| ES | 2531205 | T3 | 3/2015 |
| IN | 36/2012 | A | 9/2012 |
| JP | 2011-111891 | A | 6/2011 |
| JP | 5374480 | B2 | 12/2013 |
| KR | 20110059547 | A | 6/2011 |
| KR | 101250212 | B1 | 4/2013 |
| MX | 2011003645 | A | 5/2011 |
| NL | 9102014 | A | 6/1993 |
| NZ | 543540 | A | 3/2006 |
| NZ | 544558 | A | 6/2006 |
| NZ | 544559 | A | 6/2006 |
| PT | 1657370 | E | 3/2015 |
| RU | 2010147924 | A | 5/2012 |
| RU | 2465411 | C2 | 10/2012 |
| SG | 122955 | A1 | 6/2006 |
| SG | 141433 | A1 | 4/2008 |
| SG | 171558 | A1 | 6/2011 |
| TW | 201135017 | A | 10/2011 |
| TW | I470138 | B | 1/2015 |
| WO | WO02/13668 | | 2/2002 |
| WO | WO2007/027801 | | 3/2007 |
| WO | WO-2007/027801 | A2 | 3/2007 |
| WO | WO2009/092201 | | 7/2009 |
| WO | WO-2010/041142 | A1 | 4/2010 |
| WO | WO2013/064262 | | 5/2013 |
| ZA | 200509145 | B | 8/2006 |

OTHER PUBLICATIONS

Chinese Office Action for Chinese Application No. 201811061380.4 dated Mar. 24, 2020, with English key points.
Chinese Office Action for Chinese Application No. 201811061380.4 dated Oct. 13, 2020.

* cited by examiner

URINAL WITH TRAPWAY CONNECTION SYSTEM

CROSS-REFERENCE TO RELATED PATENT APPLICATION

The present Application claims the benefit of U.S. Provisional Patent Application No. 62/559,341 filed on Sep. 15, 2017, the entire disclosure of which is incorporated by reference herein.

BACKGROUND

The present Application relates generally to urinals. In particular, the present Application relates to a trapway connection system for a urinal.

Generally speaking, urinals are secured to a wall through a fastener connection that is accessible via recesses in the side of the urinal. These recesses are often difficult to clean and may serve as hand holds for vandalism. Urinals typically utilize a trapway to transfer liquid (e.g., urine, etc.) from inside the urinal to a drain. Traditionally, this trapway is integrated within the urinal. As a result, contents of the trapway (e.g., urine, etc.) may be susceptible to spilling when the urinal is uninstalled or removed from the wall (e.g., for servicing, etc.).

SUMMARY

One another embodiment of the present disclosure is related to a urinal. The urinal includes a bowl assembly and a trapway assembly. The bowl assembly includes a body. The body defines a bowl and a cavity. The cavity includes a receiver configured to receive a bracket. The trapway assembly is configured to be located in the cavity. The trapway assembly is configured to fluidly couple the bowl to a drain. The trapway assembly is configured to be coupled to the drain separate from the bowl assembly. The bowl assembly is configured to be coupled to a wall separate from the trapway assembly.

Another embodiment of the present disclosure is related to a urinal. The urinal includes a bowl assembly and a trapway assembly. The bowl assembly includes a body. The body defines a bowl and a cavity. The bowl assembly is configured to be coupled to a wall. The trapway assembly is configured to be located in the cavity. The trapway assembly is configured to fluidly couple the bowl to a drain. The body does not have any recesses for receiving fasteners for coupling the bowl assembly to the wall or any recesses for receiving fasteners for coupling the trapway assembly to the drain or bowl assembly.

Yet another embodiment of the present disclosure is related to a urinal. The urinal includes a bowl assembly and a trapway assembly. The bowl assembly includes a body. The body defines a bowl and a cavity. The bowl defines an opening. The bowl assembly is configured to be coupled to a wall. The trapway assembly is configured to be located in the cavity. The trapway assembly includes an inlet fitting. The trapway assembly is configured to fluidly couple the bowl to a drain and to locate the inlet fitting proximate the opening when the bowl assembly is brought into confronting relation with the wall.

Yet another embodiment of the present disclosure is related to a urinal including a bowl assembly and a trapway assembly. The bowl assembly includes a body. The body defines a bowl and a cavity. The cavity includes a receiver that receives a bracket. The trapway assembly is located in the cavity and is configured to fluidly couple the bowl to a drain. The trapway assembly is configured to be coupled to the drain separate from the bowl assembly. The bowl assembly is configured to be coupled to a wall separate from the trapway assembly.

Yet another embodiment of the present disclosure is related to a urinal including a bowl assembly and a trapway assembly. The bowl assembly includes a body. The body defines a bowl and a cavity. The cavity includes a receiver configured to receive a bracket for supporting the bowl assembly on a wall. The trapway assembly includes a structure having an extension. The trapway assembly is located in the cavity and is configured to fluidly couple the bowl to a drain. The trapway assembly is configured to be coupled to the drain separate from the bowl assembly. The bowl assembly is configured to be coupled to the wall separate from the trapway assembly. The extension is configured to cooperate with the bracket to support the bowl assembly on the wall.

Yet another embodiment of the present disclosure is related to a urinal including a bowl assembly, a trapway assembly, and a coupling assembly. The bowl assembly includes a body. The body defines a bowl and a cavity. The bowl includes an opening. The cavity includes a receiver configured to receive a bracket. The trapway assembly is located in the cavity and is configured to fluidly couple the bowl to a drain. The trapway assembly is configured to be coupled to the drain separate from the bowl assembly. The bowl assembly is configured to be coupled to a wall separate from the trapway assembly. The coupling assembly is configured to be received in the opening. The coupling assembly is configured to interface with the trapway assembly through the opening to couple the bowl assembly to the trapway assembly.

Yet another embodiment of the present disclosure is related to a urinal including a bowl assembly and a trapway assembly. The bowl assembly includes a body. The body defines a bowl and a cavity. The cavity includes a receiver configured to receive a bracket. The trapway assembly is located in the cavity and is configured to fluidly couple the bowl to a drain. The trapway assembly is configured to be coupled to the drain separate from the bowl assembly. The bowl assembly is configured to be coupled to a wall separate from the trapway assembly. The body is substantially continuous.

Yet another embodiment of the present disclosure is related to a urinal including a bowl assembly and a trapway assembly. The bowl assembly includes a body. The body defines a bowl and a cavity. The cavity includes a receiver configured to receive a bracket. The trapway assembly is located in the cavity and is configured to fluidly couple the bowl to a drain. The trapway assembly is configured to be coupled to the drain separate from the bowl assembly. The bowl assembly is configured to be coupled to a wall separate from the trapway assembly. The urinal is a waterless urinal.

It is to be understood that both the foregoing general description and the following detailed description are exemplary and explanatory only, and are not restrictive of the invention as claimed.

DETAILED DESCRIPTION

Before turning to the figures, which illustrate the exemplary embodiments in detail, it should be understood that the present Application is not limited to the details or methodologies set forth in the description or illustrated in the figures. It should also be understood that the terminology used is for the purpose of description only and should not be regarded as limiting.

Conventional urinals typically incorporate a trapway integrated within (e.g., built into, etc.) the urinal. The trapway collects liquid (e.g., urine, etc.) during use of the urinal. When the conventional urinal is uninstalled, liquid contained in the trapway may spill from the urinal. As a result, maintenance and replacement of conventional urinals is often unenjoyable. In order to uninstall conventional urinals, the trapway has to be unfastened from a drain. Typically, conventional urinals include recesses (e.g., side pockets, etc.) which provide access to fasteners that fasten the trapway to the drain. The recesses are often difficult to clean and serve as hand holds for vandalism.

The urinal described herein utilizes a separable trapway assembly that is coupled to a drain separate from a bowl assembly which is coupled to a wall using a mounting assembly and secured to the trapway assembly using a coupling assembly. The trapway assembly allows the bowl assembly to be removed independent of (e.g., separate from, etc.) the trapway assembly such that liquid in the trapway assembly is substantially maintained in the trapway assembly when the bowl assembly is removed. As a result, uninstallation, maintenance, and installation of the urinal described herein are more enjoyable than that of a conventional urinal having an integrated trapway. Because the bowl assembly can be removed independent of the trapway assembly, the urinal described herein does not require recesses for accessing fasteners that secure the trapway assembly to the drain. As a result, the urinal described herein is easier to clean and less prone to vandalism than conventional urinals.

Figure 1:
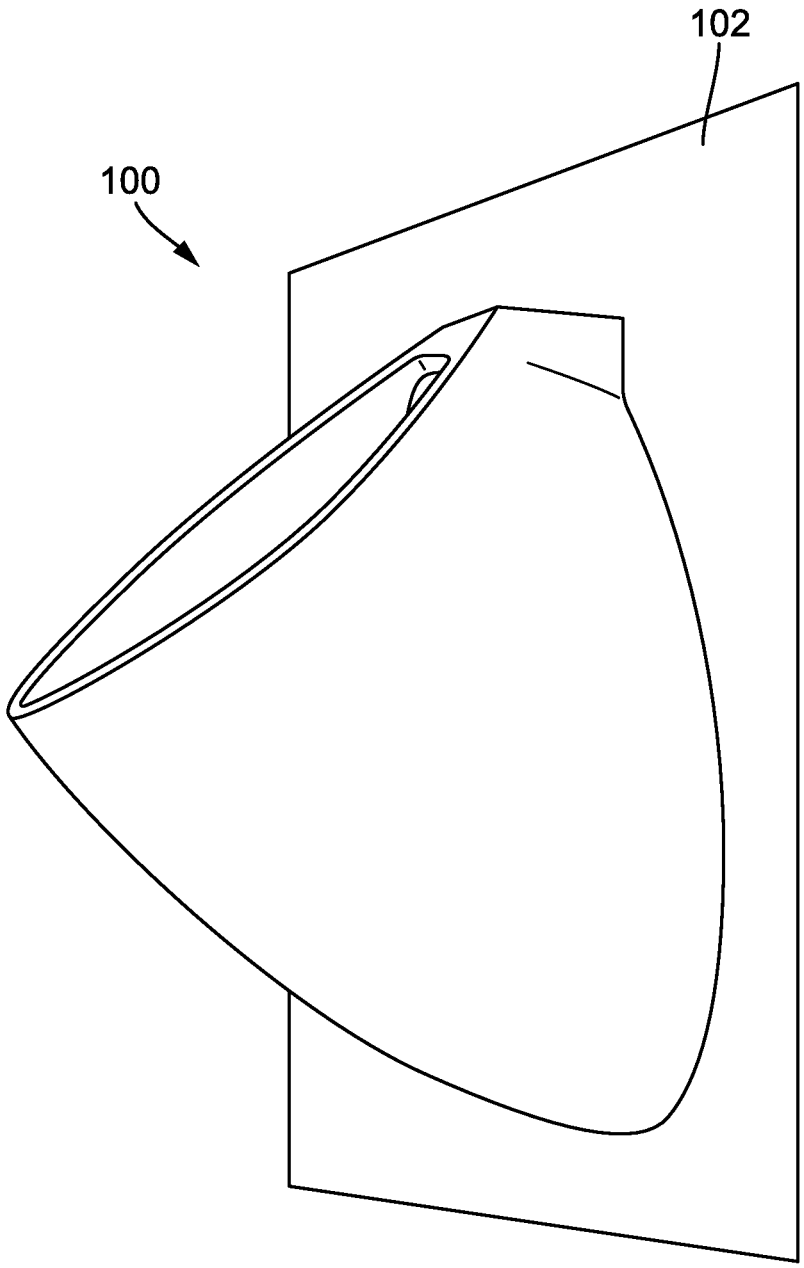
FIG. 1 is a side perspective view of a urinal mounted to a wall according to an exemplary embodiment.

Referring to FIGS. 1-4, a urinal, shown as urinal 100, is shown according to an exemplary embodiment. Urinal 100 receives liquid (e.g., urine, human waste, etc.) and provides the liquid to a conduit (e.g., pipe, etc.) for transportation to a receptacle (e.g., septic tank, storage tank, etc.) or to a treatment facility. According to various embodiments, urinal 100 is a waterless urinal. In these embodiments, urinal 100 does not receive liquid (e.g., water, etc.) from a conduit in wall 102. Urinal 100 may be implemented in a restroom (e.g., public restroom, bathroom, washroom, powder room, etc.). As shown in FIG. 1, urinal 100 is shown mounted to (e.g., attached to, coupled to, etc.) a surface, shown as wall 102. While only one urinal 100 is shown mounted to wall 102, additional urinals 100 may also be mounted to wall 102. For example, a series of urinals 100 may be equally spaced along wall 102. According to various embodiments, urinal 100 is mounted to wall 102 such that urinal 100 is substantially flush with wall 102.

Figure 2:
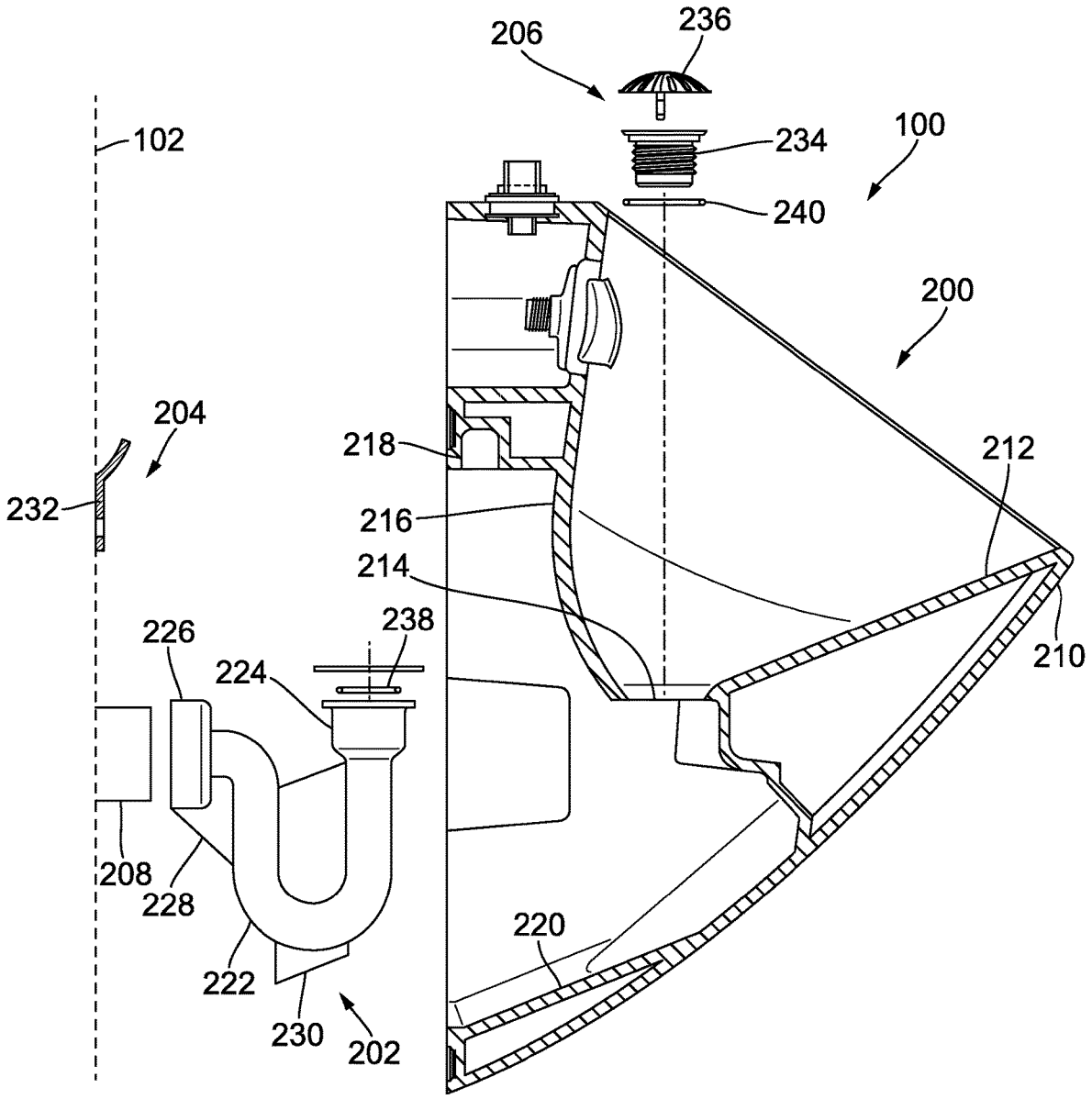
FIG. 2 is a cross-sectional, exploded view of the exemplary embodiment of the urinal shown in FIG. 1.
Figure 3:
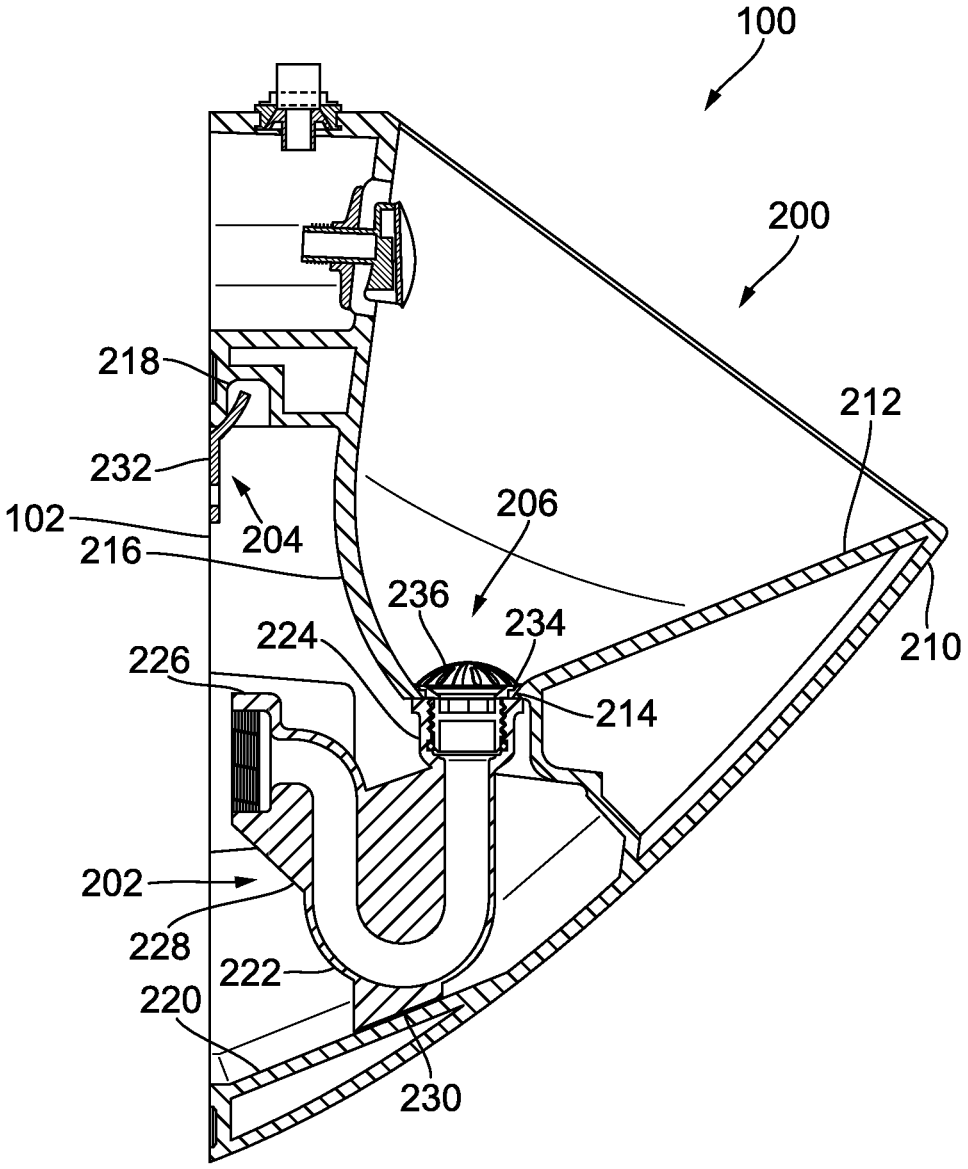
FIG. 3 is a cross-sectional view of the exemplary embodiment of the urinal shown in FIG. 1.

As shown in FIG. 2, urinal 100 includes a first assembly, shown as bowl assembly 200, a second assembly, shown as trapway assembly 202, a third assembly, shown as mounting assembly 204, and a fourth assembly, shown as coupling assembly 206. Bowl assembly 200 is configured to receive liquid (e.g., urine, human waste, water, etc.). Bowl assembly 200 is also configured to receive trapway assembly 202. Trapway assembly 202 is configured to receive the liquid from bowl assembly 200 and to provide the liquid to a conduit (e.g., fluid return, pipe, outlet, etc.), shown as drain 208. Trapway assembly 202 is separate from bowl assembly 200 and is not integrated in bowl assembly 200. Drain 208 may ultimately provide the liquid to a receptacle (e.g., septic tank, storage tank, etc.) or to a treatment facility.

Mounting assembly 204 is secured to wall 102. For example, mounting assembly 204 may be fastened or otherwise attached to wall 102. Mounting assembly 204 is configured to selectively couple (e.g., engage, mate, etc.) with bowl assembly 200, thereby selectively coupling bowl assembly 200 to wall 102. When bowl assembly 200 is coupled to mounting assembly 204, mounting assembly 204 is configured to support bowl assembly 200. In an exemplary embodiment, mounting assembly 204 is positioned above drain 208.

Coupling assembly 206 is configured to selectively secure bowl assembly 200 to trapway assembly 202. According to various embodiments, coupling assembly 206 interfaces with trapway assembly 202 through bowl assembly 200. Coupling assembly 206 may be configured to minimize leakage of the liquid as it is provided from bowl assembly 200 to trapway assembly 202. In some applications, coupling assembly 206 may be removed for cleaning of coupling assembly 206 and/or trapway assembly 202.

Bowl assembly 200 includes a frame (e.g., shell, case, etc.), shown as body 210. Body 210 may be constructed from various materials such as vitreous china, plastic (e.g., polymers, thermoplastics, resins, etc.), porcelain, metals (e.g., aluminum, etc.), ceramics, and other similar materials. Depending on the material, body 210 may be constructed through various processes such as casting, molding (e.g., injection molding, etc.), forming, and other similar processes. Body 210 may be coated with various paints, enamels, surface treatments (e.g., anti-microbial treatments, anodizing, etc.), and other similar coatings. Different portions of body 210 may be coated with different coatings. Depending on the application of urinal 100, body 210 may have different shapes. For example, body 210 may be rounded, elongated, curved, contoured, edged, or otherwise shaped.

Body 210 defines a receptacle, shown as bowl 212. Bowl 212 may be configured to facilitate reception of liquid and transmission of the liquid to trapway assembly 202. According to various embodiments, bowl 212 is configured to maximize transmission of the liquid to trapway assembly 202 via gravitational forces. In one embodiment, bowl 212 is coated with a coating configured to maximize transmission of the liquid to trapway assembly 202, such as a hydrophobic coating. Bowl 212 defines an opening, shown as opening 214. In an exemplary embodiment, opening 214 is located at the bottom-most point of bowl 212. According to various embodiments, opening 214 is configured to receive coupling assembly 206. In some alternative embodiments, opening 214 is additionally or alternatively configured to receive trapway assembly 202.

According to various embodiments, body 210 is substantially continuous (e.g., seamless, etc.). Because trapway assembly 202 is separate from bowl assembly 200, body 210 does not have any recesses for receiving fasteners that couple trapway assembly 202 to drain 208 or bowl assembly 200. Additionally, because mounting assembly 204 does not use fasteners to couple bowl assembly 200 to wall 102, body 210 does not have any recesses for receiving fasteners that couple bowl assembly 200 to wall 102. As a result, body 210 is easier to clean than conventional urinals that include these recesses. Body 210 may also be less prone to vandalism than conventional urinals that include these recesses.

Body 210 also defines a cavity, shown as cavity 216. Cavity 216 is configured to receive trapway assembly 202. When urinal 100 is removed (e.g., decoupled, etc.) from wall 102, coupling assembly 206 is first decoupled from trapway assembly 202 and then removed. Then, bowl assembly 200 is decoupled from mounting assembly 204. As bowl assembly 200 is decoupled from mounting assembly 204, trapway assembly 202 remains coupled to drain 208. This allows liquid in trapway assembly 202 to remain substantially undisturbed as bowl assembly 200 is removed. In contrast, conventional urinals utilize built-in (e.g., stuck on, integral, etc.) trapways. When a conventional urinal is removed from a wall, the trapway is simultaneously removed from an outlet and liquid (e.g., urine, etc.) in the trapway may be prone to spilling. As a result, removal of conventional urinals is often an unpleasant task.

Cavity 216 may be oversized relative to trapway assembly 202. This may help to ensure that liquid in trapway assembly 202 remains substantially undisturbed. Cavity 216 may be configured to minimize weight of urinal 100. Similarly, cavity 216 may be symmetrical about a vertical, bisecting plane that is orthogonal to wall 102. In this way, cavity 216 may facilitate balancing of bowl assembly 200 on mounting assembly 204. Additionally, cavity 216 may be configured to optimize weight distribution on mounting assembly 204 and trapway assembly 202 such that bowl assembly 200 may be optimally secured on wall 102.

Cavity 216 defines an opening (e.g., slot, hole, port, etc.), shown as receiver 218, and a surface (e.g., face, panel, etc.), shown as lower surface 220. Receiver 218 is configured to interface with mounting assembly 204 to support bowl assembly 200 on wall 102. According to various embodiments, receiver 218 is configured to interface with mounting assembly 204 without the use of fasteners.

In some embodiments, lower surface 220 is configured to interface with trapway assembly 202. The interaction between lower surface 220 and trapway assembly 202 may assist mounting assembly 204 in supporting bowl assembly 200. Further, this interaction may assist bowl assembly 200 in coupling to mounting assembly 204. For example, as lower surface 220 contacts trapway assembly 202, mounting assembly 204 may be inserted into receiver 218.

Trapway assembly 202 includes a conduit (e.g., pipe, etc.), shown as trapway 222, having a first end (e.g., connector, coupler, etc.), shown as inlet fitting 224, and a second end (e.g., connector, coupler, etc.), shown as outlet fitting 226. According to various embodiments, trapway 222 is generally U-shaped. According to various embodiments, inlet fitting 224 is configured to interface with coupling assembly 206, and outlet fitting 226 is configured to interface with drain 208. The shape, size, diameter, and configuration of trapway 222, inlet fitting 224, and outlet fitting 226 may be varied such that urinal 100 is tailored for a target application.

Trapway assembly 202 also includes a body (e.g., frame, etc.), shown as trapway structure 228. Trapway structure 228 may provide rigidity to trapway 222. In various embodiments, trapway 222 is integrated within trapway structure 228. According to an exemplary embodiment, trapway structure 228 includes an extension, shown as extension 230. Extension 230 is configured to interface with lower surface 220. According to various embodiments, extension 230 is shaped to substantially align inlet fitting 224 with opening 214 through this interaction. Additionally or alternatively, extension 230 may support bowl assembly 200 through the interaction between lower surface 220 and extension 230. Extension 230 may cause inlet fitting 224 to come into contact with, or to protrude from, opening 214. Extension 230 may be shaped to facilitate a target interaction between mounting assembly 204 and receiver 218. For example, extension 230 may be shaped such that mounting assembly 204 is guided into receiver 218 according to a target trajectory. Similarly, extension 230 may be shaped to match a contour of lower surface 220. Additionally, extension 230 may be shaped to facilitate a target interaction between opening 214 and inlet fitting 224. For example, extension 230 may be shaped such that as bowl assembly 200 is brought into confronting relation with wall 102, extension 230 contacts lower surface 220 such that inlet fitting 224 is guided towards opening 214 causing inlet fitting 224 to be located proximate opening 214 and/or aligned with opening 214 when bowl assembly 200 is coupled to wall 102 (e.g., when bracket 232 is received within receiver 218, etc.).

Mounting assembly 204 includes a member, shown as bracket 232. Bracket 232 is configured to be secured to wall 102 and to be received in receiver 218. According to various embodiments, bracket 232 is secured to wall 102 through the use of fasteners (e.g., screws, nails, bolts, etc.). In other embodiments, bracket 232 is secured to wall 102 through the use of adhesive (e.g., glue, resin, tape, etc.). In an exemplary embodiment, bracket 232 is substantially aligned with drain 208. Mounting assembly 204 may include a plurality of brackets 232. For example, mounting assembly 204 may include two brackets 232, each spaced an equal distance from drain 208 and on either side of drain 208. In these embodiments, cavity 216 includes a corresponding number of brackets 232 configured to be substantially aligned with brackets 232 when bowl assembly 200 is coupled to mounting assembly 204.

According to an alternative embodiment, urinal 100 does not include mounting assembly 204. For example, urinal 100 may be secured to wall 102 through the use of fasteners through body 210. In other applications, wall 102 includes bracketry configured to receive urinal 100. For example, in retrofitting applications, wall 102 may include bracketry from a previously installed urinal such that the bracketry can be reused to secure urinal 100 to wall 102.

According to various embodiments, coupling assembly 206 includes a fitting, shown as coupler 234, and a strainer (e.g., grate, top, etc.), shown as strainer 236. In an exemplary embodiment, opening 214 is configured to partially receive coupler 234 and coupler 234 is configured to interface with inlet fitting 224 such that bowl 212 is positioned between coupler 234 and inlet fitting 224. In some embodiments, coupler 234 is configured to threadably engage inlet fitting 224. In an alternative embodiment, coupler 234 is press fit, snap fit, interference fit, or otherwise coupled to inlet fitting 224. The diameter, length, and other similar characteristics of coupler 234 may be varied such that urinal 100 is tailored for a target application.

Strainer 236 is configured to be received in coupler 234. For example, strainer 236 may be secured to coupler 234 through a threaded interface, press fit, snap fit, interference fit, or otherwise secured to coupler 234. According to an exemplary embodiment, strainer 236 is configured to be removable to facilitate cleaning or urinal 100. For example, strainer 236 may be removable via a tool-less interface. Strainer 236 may be interchangeable such that urinal 100 may be tailored for a target application. In some embodiments, coupling assembly 206 does not include strainer 236. In other applications, strainer 236 is integrated in (e.g., built into, etc.) coupler 234.

According to an alternative embodiment, urinal 100 does not include coupling assembly 206. For example, coupler 234 and strainer 236 may be integrated in (e.g., built into, etc.) bowl assembly 200. In another example, inlet fitting 224 is configured to interface with, and extend from, opening 214. In this example, inlet fitting 224 may be press fit, snap fit, interference fit, or otherwise interfaced with opening 214.

In some applications, a first seal, shown as lower seal 238, and a second seal, shown as upper seal 240, are utilized in the interface between inlet fitting 224, bowl 212, and coupler 234 to prevent leakage of liquid. Lower seal 238 and upper seal 240 may be O-rings. In some applications, lower seal 238 and upper seal 240 are compressible. According to an exemplary embodiment, lower seal 238 is located between inlet fitting 224 and bowl 212, and upper seal 240 is located between coupler 234 and bowl 212.

Figure 4:
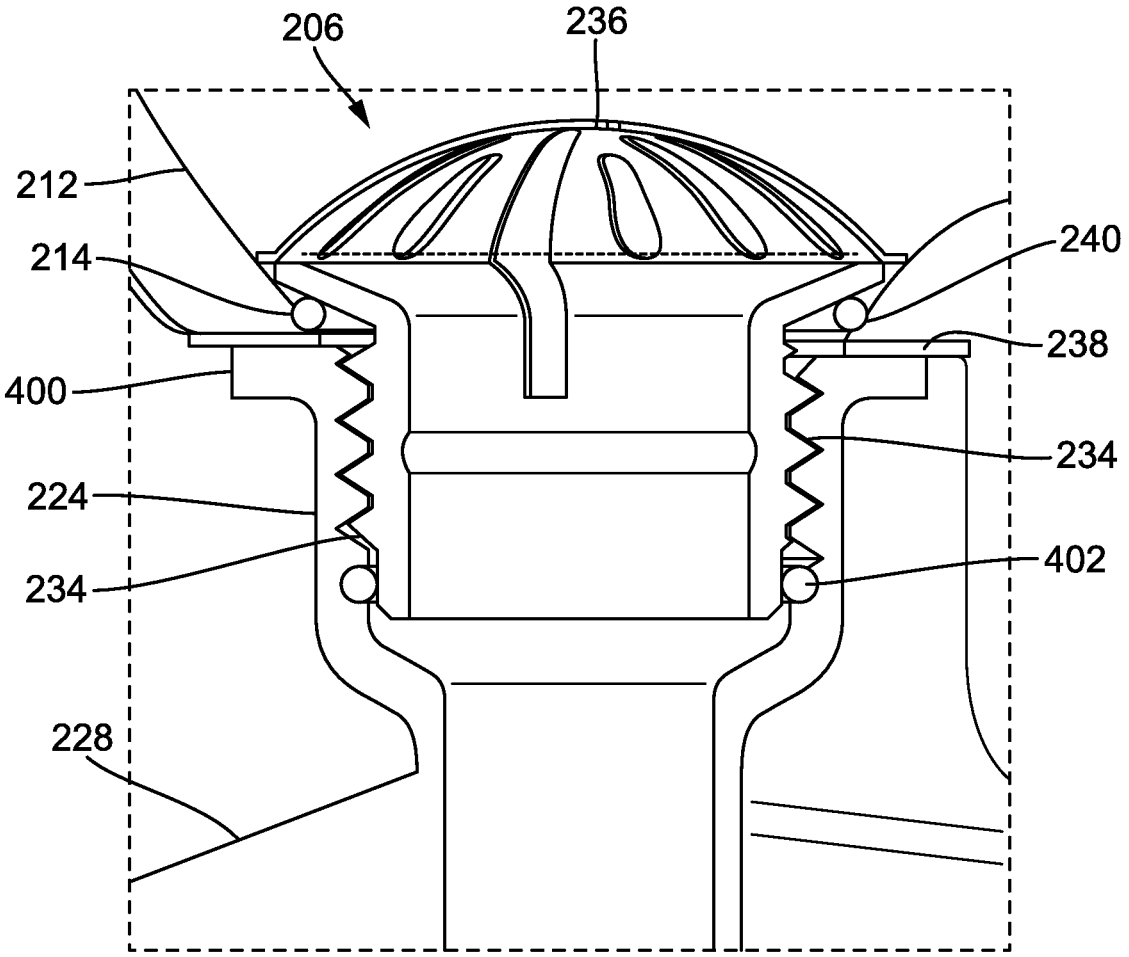
FIG. 4 is detailed cross-sectional view of the exemplary embodiment of the urinal shown in FIG. 1.

As shown in FIG. 4, coupler 234 includes a threaded pattern configured to interface with a threaded pattern inside of inlet fitting 224. When coupler 234 is threaded into inlet fitting 224, upper seal 240 is compressed between coupler 234 and bowl 212, and lower seal 238 is compressed between a flange of inlet fitting 224, shown as flange 400, and bowl 212. A seal, shown as auxiliary seal 402 may be located inside of inlet fitting 224. Auxiliary seal 402 may interface with coupler 234 when coupler 234 is received in inlet fitting 224.

Figure 5:
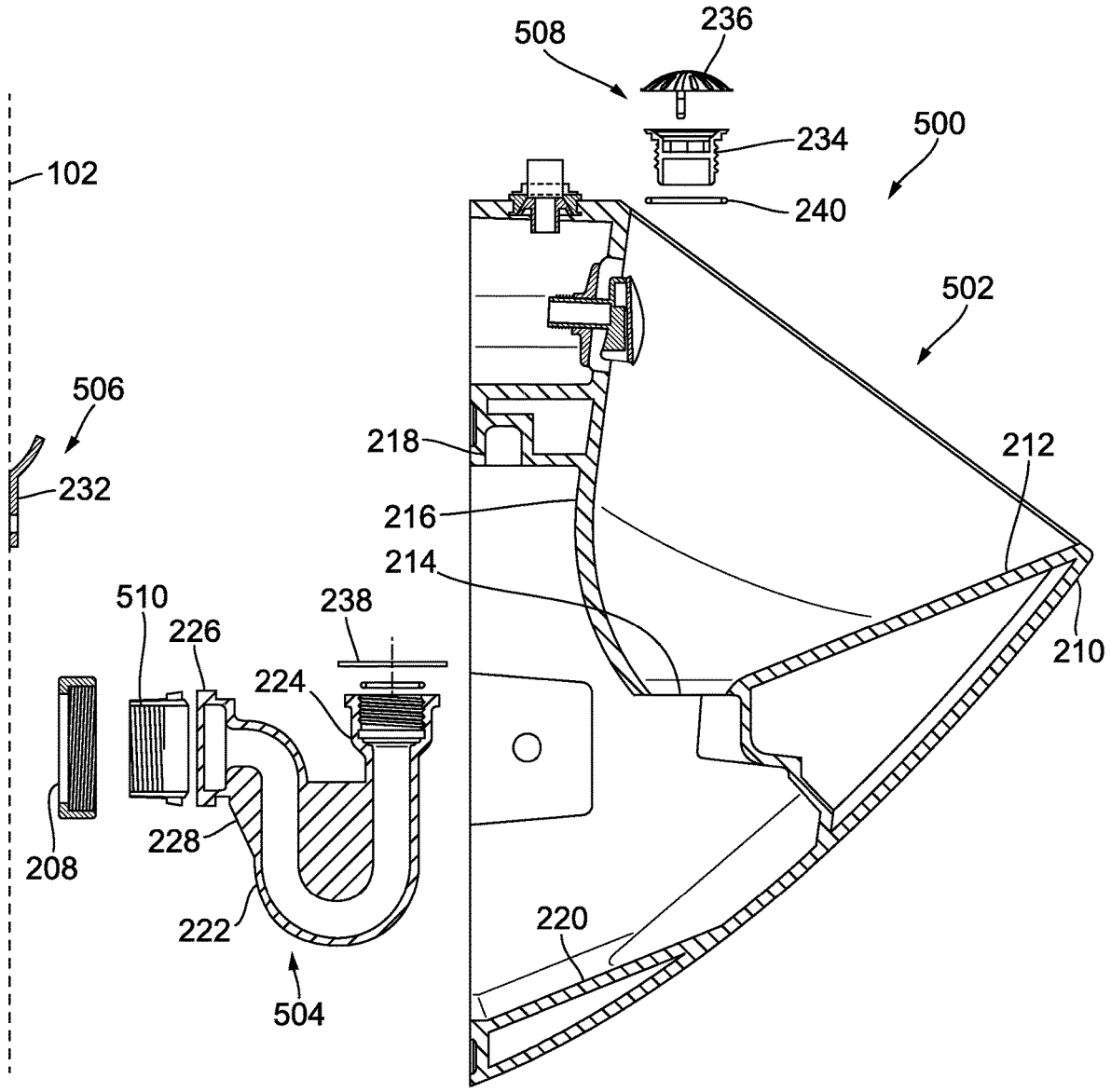
FIG. 5 is a cross-sectional, exploded view of an another urinal mounted to a wall according to an exemplary embodiment.
Figure 6:
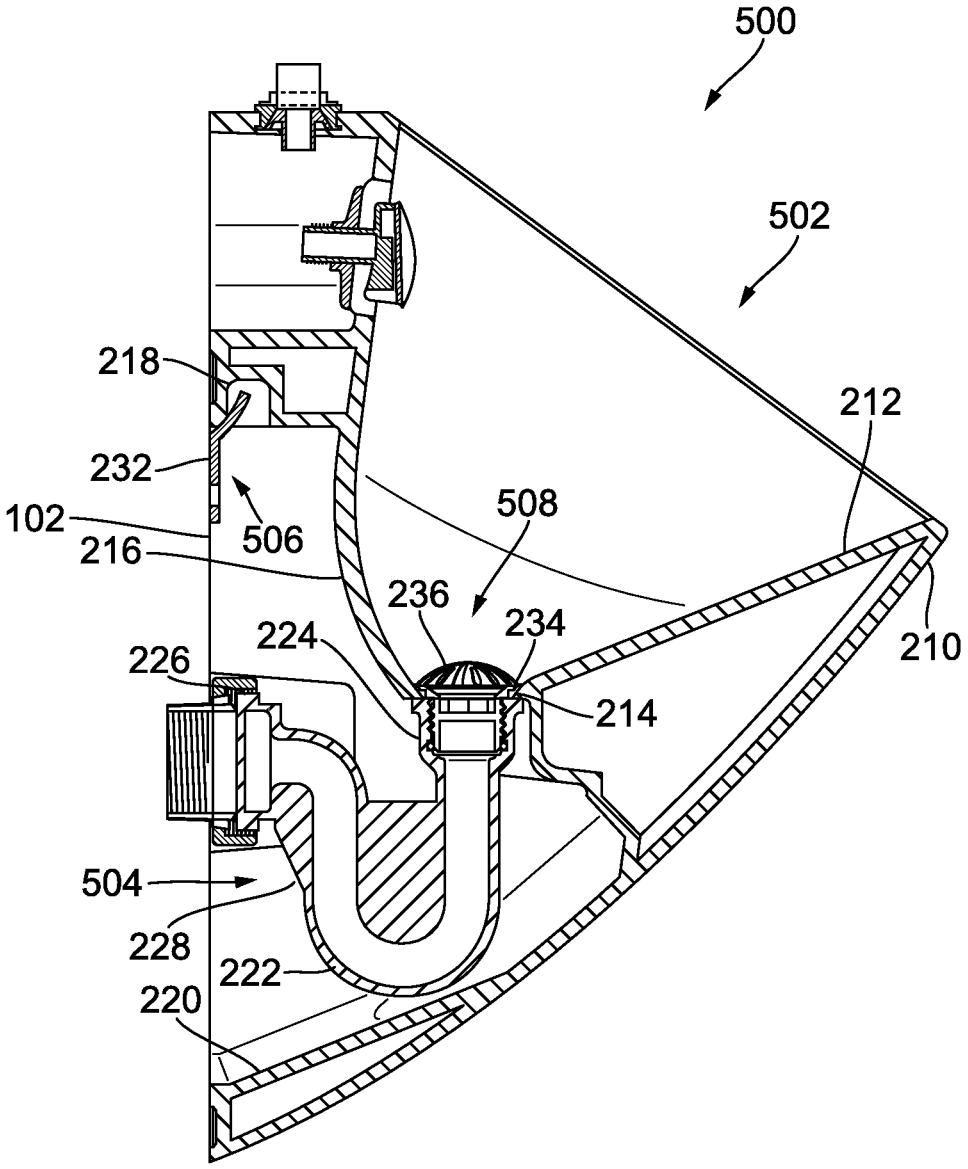
FIG. 6 is a cross-sectional view of the exemplary embodiment of the urinal shown in FIG. 5.

As shown in FIGS. 5 and 6, a urinal, shown as urinal 500, is shown as an alternative to urinal 100 as previously described. Urinal 500 includes a first assembly, shown as bowl assembly 502, a second assembly, shown as trapway assembly 504, a third assembly, shown as mounting assembly 506, and a fourth assembly, shown as coupling assembly 508. Urinal 500 partly differentiates from urinal 100 in that trapway assembly 504 includes a connector, shown as union 510, that couples drain 208 to outlet fitting 226. The interaction between union 510, drain 208, and outlet fitting 226 may expedite removal and/or replacement of trapway assembly 504 (e.g., such as occurs when trapway assembly 504 is removed for servicing, etc.). Specifically, union 510, drain 208, and outlet fitting 226 cooperate such that a full rotation of trapway assembly 504 is not required to decouple outlet fitting 226 from drain 208. This may substantially prevent contents within trapway assembly 504 from spilling out of trapway assembly 504 when trapway assembly 504 is removed for servicing. Additionally, union 510 maintains a spacing between wall 102 and outlet fitting 226. Trapway assembly 504 is shown to include trapway structure 228 as previously described but without extension 230. However, in other embodiments, trapway assembly 504 may include extension 230 as previously described.

In some alternative embodiments, urinal 100 receives liquid (e.g., from a conduit in wall 102 and selectively provides the liquid to bowl 212 (e.g., in response to flush command, etc.). In these embodiments, urinal 100 does not utilize the liquid with every use of urinal 100, as would be done in a non-waterless urinal, but rather uses the liquid for regular flushes of urinal 100. In some embodiments, wall 102 provides urinal 100 with an auxiliary connection (e.g., electrical connection, etc.). For example, wall 102 may provide urinal 100 electricity for powering devices on urinal 100 (e.g., motion detectors, illumination detectors, etc.).

Various components of urinal 100 (e.g., components of bowl assembly 200, components of trapway assembly 202, components of mounting assembly 204, components of coupling assembly 206, etc.) may be constructed of various materials such as brass, aluminum, polymeric material, thermoset, polymeric based blend, polymer, nylon, rubber, synthetic rubber, polyvinyl chloride, polytetrafluoroethylene, ceramic, ceramic blend, ceramic-metallic blend, vitreous china, alumina, metallic blend, zinc, alloy, brass, aluminum, steel, or any other suitable material such that urinal 100 may be tailored for a target application.

As utilized herein, the terms "approximately," "about," "substantially," and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the invention as recited in the appended claims.

Additionally, the word "exemplary" is used to mean serving as an example, instance, or illustration. Any embodiment or design described herein as "exemplary" is not necessarily to be construed as preferred or advantageous over other embodiments or designs (and such term is not intended to connote that such embodiments are necessarily extraordinary or superlative examples). Rather, use of the word "exemplary" is intended to present concepts in a concrete manner. Accordingly, all such modifications are intended to be included within the scope of the present disclosure. Other substitutions, modifications, changes, and omissions may be made in the design, operating conditions, and arrangement of the preferred and other exemplary embodiments without departing from the scope of the appended claims.

The terms "coupled," "connected," and the like, as used herein, mean the joining of two members directly or indirectly to one another. Such joining may be stationary (e.g., permanent) or moveable (e.g., removable or releasable). Such joining may be achieved with the two members or the two members and any additional intermediate members being integrally formed as a single unitary body with one another or with the two members or the two members and any additional intermediate members being attached to one another.

References herein to the positions of elements (e.g., "top," "bottom," "above," "below," etc.) are merely used to describe the orientation of various elements in the FIGURES. It should be noted that the orientation of various elements may differ according to other exemplary embodiments and that such variations are intended to be encompassed by the present disclosure.

The construction and arrangement of the elements of the urinal and all other elements and assemblies as shown in the exemplary embodiments are illustrative only. Although only a few embodiments of the present disclosure have been described in detail, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements, the position of elements may be reversed or otherwise varied, and the nature or number of discrete elements or positions may be altered or varied.

Other substitutions, modifications, changes and omissions may also be made in the design, operating conditions and arrangement of the various exemplary embodiments without departing from the scope of the present invention. For example, any element (e.g., trapway 222, coupler 234, etc.) disclosed in one embodiment may be incorporated or utilized with any other embodiment disclosed herein. Also, for example, the order or sequence of any process or method steps may be varied or re-sequenced according to alternative embodiments. Any means-plus-function clause is intended to cover the structures described herein as performing the recited function and not only structural equivalents but also equivalent structures. Other substitutions, modifications, changes, and omissions may be made in the design, operating configuration, and arrangement of the preferred and other exemplary embodiments without departing from the scope of the appended claims.

What is claimed is:

1. A urinal, comprising:

a bowl assembly comprising a body, the body comprising a bowl and a cavity, the cavity of the body comprising a receiver configured to receive a bracket; and a trapway assembly comprising a trapway including a U-shaped portion and being configured such that the U-shaped portion of the trapway is placed within the cavity of the body as the bowl assembly is coupled to the wall, the trapway assembly configured to fluidly couple the bowl to a drain;

wherein the trapway assembly is configured to be coupled to the drain separate from the bowl assembly; and wherein the bowl assembly is configured to be coupled to a wall separate from the trapway assembly.

2. The urinal of claim 1, wherein:

the bracket is configured to be attached to the wall; and the receiver is configured to support the bowl assembly on the wall through the bracket.

3. The urinal of claim 1, wherein:

the trapway assembly comprises an extension; and the extension is configured to guide the bracket into the receiver as the bowl assembly is brought into confronting relation with the wall.

4. The urinal of claim 1, wherein:

the bowl defines an opening and the bowl is configured to direct fluid into the opening;

the trapway assembly comprises an inlet fitting; and the trapway assembly is configured to locate the inlet fitting proximate the opening when the bracket is received within the receiver.

5. The urinal of claim 4, further comprising a coupling assembly comprising a coupler configured to be coupled to the inlet fitting through the opening;

wherein the bowl assembly is configured to be secured to the trapway assembly only through the coupler.

6. The urinal of claim 5, wherein:

the trapway assembly comprises an extension; and the extension is configured to guide the inlet fitting towards the opening as the bowl assembly is brought into confronting relation with the wall such that the inlet fitting is located proximate the opening when the bracket is received within the receiver.

7. The urinal of claim 1, wherein the body does not have any recesses for receiving fasteners for coupling the bowl assembly to the wall or any recesses for receiving fasteners for coupling the trapway assembly to the drain or bowl assembly.

8. The urinal of claim 1, wherein the receiver and bracket facilitate coupling of the bowl assembly to the wall independent of the trapway assembly.

9. A urinal, comprising:

a bowl assembly comprising a body, the body comprising a bowl and a cavity, the bowl assembly configured to be coupled to a wall; and a trapway assembly comprising a trapway including a U-shaped portion, the U-shaped portion of the trapway placed within the cavity of the body as the bowl assembly is coupled to the wall, the trapway assembly configured to fluidly couple the bowl to a drain;

wherein the body does not have any recesses for receiving fasteners for coupling the bowl assembly to the wall or any recesses for receiving fasteners for coupling the trapway assembly to the drain or bowl assembly.

10. The urinal of claim 9, wherein:

the bowl defines an opening;

the trapway assembly comprises an inlet fitting; and the trapway assembly is configured to locate the inlet fitting proximate the opening when the bowl assembly is brought into confronting relation with the wall.

11. The urinal of claim 10, further comprising a coupling assembly comprising a coupler configured to be coupled to the inlet fitting through the opening;

wherein the bowl assembly is configured to be secured to the trapway assembly only through the coupler.

12. The urinal of claim 11, wherein:

the trapway assembly comprises an extension; and the extension is configured to guide the inlet fitting towards the opening as the bowl assembly is brought into confronting relation with the wall such that the inlet fitting is located proximate the opening when the bowl assembly is coupled to the wall.

13. The urinal of claim 9, wherein:

the trapway assembly is configured to be coupled to the drain separate from the bowl assembly; and the bowl assembly is configured to be coupled to the wall separate from the trapway assembly.

14. The urinal of claim 9, wherein the bowl assembly is configured to be coupled to the wall independent of the trapway assembly.

15. A urinal, comprising:

a bowl assembly comprising a body, the body comprising a bowl and a cavity, the bowl defining an opening, the bowl assembly configured to be coupled to a wall; and a trapway assembly comprising a trapway including a U-shaped portion, the U-shaped portion of the trapway configured to be located in the cavity of the body, the trapway assembly comprising an inlet fitting and configured to fluidly couple the bowl to a drain and to locate the inlet fitting proximate the opening when the bowl assembly is brought into confronting relation with the wall and the trapway is placed within the cavity.

16. The urinal of claim 15, further comprising a coupling assembly comprising a coupler configured to be coupled to the inlet fitting through the opening;

wherein the bowl assembly is configured to be secured to the trapway assembly only through the coupler.

17. The urinal of claim 16, wherein:

the trapway assembly comprises an extension; and the extension is configured to guide the inlet fitting towards the opening as the bowl assembly is brought into confronting relation with the wall such that the inlet fitting is located proximate the opening when the bowl assembly is coupled to the wall.

18. The urinal of claim 15, wherein:

the trapway assembly is configured to be coupled to the drain separate from the bowl assembly; and the bowl assembly is configured to be coupled to the wall separate from the trapway assembly.

19. The urinal of claim 18, wherein the body does not have any recesses for receiving fasteners for coupling the bowl assembly to the wall or any recesses for receiving fasteners for coupling the trapway assembly to the drain or bowl assembly.

20. The urinal of claim 15, wherein the bowl assembly is configured to be coupled to the wall independent of the trapway assembly.

* * * * *